United States Patent [19]

Rünkel et al.

[11] Patent Number: 4,529,378

[45] Date of Patent: Jul. 16, 1985

[54] HEATING CHAMBER FOR PROCESSING ADVANCING YARN

[75] Inventors: Walter Rünkel, Hückeswagen; Erich Lenk; Karl Bauer, both of Remscheid, all of Fed. Rep. of Germany

[73] Assignee: Barmag Barmer Maschinenfabrik AG, Remscheid, Fed. Rep. of Germany

[21] Appl. No.: 563,299

[22] Filed: Dec. 19, 1983

[30] Foreign Application Priority Data

| | | | |
|---|---|---|---|
| Dec. 18, 1982 | [DE] | Fed. Rep. of Germany | 3247040 |
| Dec. 23, 1982 | [DE] | Fed. Rep. of Germany | 3247626 |
| Feb. 11, 1983 | [DE] | Fed. Rep. of Germany | 3304752 |
| Mar. 9, 1983 | [DE] | Fed. Rep. of Germany | 3308251 |
| Apr. 9, 1983 | [DE] | Fed. Rep. of Germany | 3312823 |
| May 21, 1983 | [DE] | Fed. Rep. of Germany | 3318645 |
| Jun. 11, 1983 | [DE] | Fed. Rep. of Germany | 3321202 |
| Jul. 22, 1983 | [DE] | Fed. Rep. of Germany | 3326432 |
| Oct. 5, 1983 | [DE] | Fed. Rep. of Germany | 3336101 |

[51] Int. Cl.[3] ..... F27B 9/28; F26B 13/00

[52] U.S. Cl. ..... 432/59; 34/160

[58] Field of Search ..... 432/8, 59; 34/160

[56] References Cited

U.S. PATENT DOCUMENTS

| | | | |
|---|---|---|---|
| 2,228,272 | 1/1941 | Kinsella . | |
| 2,351,110 | 6/1944 | Davidson et al. | 68/5 E |
| 2,529,563 | 11/1950 | Miller . | |
| 2,708,843 | 5/1955 | Gibson et al. . | |
| 2,954,687 | 10/1960 | Yazawa et al. . | |
| 3,079,746 | 3/1963 | Field, Jr. . | |
| 3,298,430 | 1/1967 | Kodaira . | |
| 3,796,538 | 3/1974 | Howorth . | |
| 4,100,660 | 7/1978 | Nemecek et al. . | |
| 4,198,835 | 4/1980 | Luthi . | |
| 4,226,092 | 10/1980 | Luthi . | |
| 4,398,386 | 8/1983 | Endo et al. . | |

FOREIGN PATENT DOCUMENTS

| | | |
|---|---|---|
| 2703991 | 8/1977 | Fed. Rep. of Germany . |
| 2840177 | 3/1980 | Fed. Rep. of Germany . |

*Primary Examiner*—John J. Camby

*Attorney, Agent, or Firm*—Bell, Seltzer, Park & Gibson

[57] ABSTRACT

A yarn heating chamber is disclosed which is adapted for thermally processing an advancing yarn. The chamber comprises first and second members each having a discontinuity in the form of a groove, shoulder or the like in the front surface thereof, and the members are movably mounted with respect to each other between an operative position wherein the discontinuities are positioned relative to each other to define a relatively narrow yarn passage, and a threading position defining an enlarged opening to facilitate threading. Also, at least one of the first and second members includes a rear surface which faces oppositely from the front surface of such member.Heating means is provided for introducing a hot pressurized vapor into the yarn passage when the members are in the operative position, and a portion of the hot pressurized vapor is directed into contact with the rear surface so that the hot pressurized vapor acts to bias the front surfaces toward each other to provide a firm contact therebetween.

25 Claims, 17 Drawing Figures

HEATING CHAMBER FOR PROCESSING ADVANCING YARN

The present invention relates to a heating chamber for thermally processing an advancing yarn, and which is suitable for treating a yarn with a pressurized and hot vapor, preferably with saturated water vapor or steam.

When heating up to more than 100° C., it is advantageous to treat a traveling yarn, in particular, a multifilament synthetic yarn, with a saturated water vapor rather than a highly superheated water vapor or hot air, since the saturated water vapor has a large, latent heat content (heat of evaporation), and the yarn may be highly heated at high yarn speeds and short dwelling times because of the very high heat transfer coefficients at condensation, in contrast to the convection, radiation or direct heat conduction. The treatment with saturated vapor also effects a uniform temperature distribution and a good temperature stability over the entire length of the treatment zone. The treatment zone may also randomly consist of several successively arranged treatment chambers, since the required uniformity and stability of the treatment temperature can be ensured for several treatment chambers by adjusting the pressure between the chambers. The losses at the inlet and outlet of the treatment zone can be kept low, and lower than in comparative hot air heating zones, when the yarn inlet and yarn outlet are designed according to the present invention. Also, the yarn is cooled at the yarn outlet by the evaporation of the previously condensed water, and if necessary, the yarn can be moistened in the area of the yarn outlet.

For this reason, the saturated vapor treatment chambers of the present invention are particularly suitable for such yarn treatments in which a large amount of heat has to be transferred to the yarn in a relatively short dwelling time, and then subsequently immediately removed, such as is the case, for example, with synthetic fibers which are handled in spinning, spin-drawing, spin-texturing, or spin-draw-texturing processes and in draw-texturing, draw-twisting, draw-winding, and other draw processes.

One problem associated with present yarn heating chambers of the described type is the fact that the heating vapor, being under an elevated pressure, escapes through the yarn inlet and the yarn outlet in such large quantities that the operation of the chamber is rendered uneconomical. To alleviate this problem, labyrinth seals and gap seals positioned at the yarn inlet and the yarn outlet are known. Labyrinth seals typically consist of a stack of discs having shutter-like openings, and which form, upon relative movement of the plates, either a wide opening in the threading position, or a labyrinth opening in the operating position, note U.S. Pat. Nos. 4,100,660; 2,529,563; and 2,351,110. Labyrinth seals are suitable for the threading operation, but they are basically unsuitable in operation, since the necessity of an unhindered yarn travel cannot be achieved by reason of the winding or intricate outlet path which is necessary to avoid losses of the heating vapor. Gap seals are effective in that a long gap length provides a sufficient reduction of vapor loss. However, as the gap length increases and narrows, the threading operation becomes more difficult, particularly in the case of a pneumatic threading of the yarn.

It is accordingly an object of the present invention to provide a yarn heating chamber which avoids the above mentioned disadvantages of known chambers, and which provides an effective and uniform heating of the components which enclose the advancing yarn, and which does not require close manufacturing tolerances.

These and other objects and advantages of the present invention are achieved in the embodiments illustrated herein by the provision of a heating chamber which comprises a first member including a front surface having an elongate longitudinal discontinuity therein, and a second member including a front surface which is substantially congruent with the surface of the first member. At least one of the two members includes a rear surface which faces oppositely from the associated front surface, and the two members are mounted for relative movement between an operative position wherein the respective front surfaces overlie each other and the discontinuity defines a relatively narrow passage for the yarn, and a threading position wherein the surface of the second member is positioned relative to the discontinuity to define an enlarged opening to facilitate threading of the yarn. The heating chamber also includes heating duct means for introducing a hot pressurized vapor into the yarn passage when the members are in the operative position, and biasing means for applying a resilient force upon the rear surface when said members are in the operative position and so as to bias the front surfaces toward each other.

In the illustrated embodiments, the biasing means includes secondary duct means which communicates with the heating duct means so that a portion of the hot pressurized vapor supplied by the heating duct means is directed into contact with the rear surface. In addition, the heating chamber of the present invention preferably also comprises a pair of sealing strips mounted on at least one of the front surfaces of the two members, with the sealing strips being disposed on respective opposite sides of the discontinuity and extending longitudinally along substantially the entire length thereof and so that in the operating position the sealing strips are sealably disposed between the front surfaces.

The yarn duct formed between the front surfaces in the operating position typically measures at the yarn inlet and/or yarn outlet about 0.2 to 0.5 mm in width, and so that a traveling yarn can move without hindrance, and while the loss of the heating vapor is low. The passage width may differ in the yarn outlet area. Also, pressure relief chambers or vacuum chambers may be connected to the passage, so as to obtain a controlled pressure relief gradient along the yarn path. When dimensioning the passage width, the diameter and the number of the yarns to be guided in the passage are considered. In the embodiments wherein each of the front surfaces possesses a groove or shoulder, the yarn passage is widened in the threading position so that the yarn can be threaded pneumatically without difficulty. In another embodiment, the yarn passage opens laterally in the threading position, so that a traveling yarn may be inserted laterally into the passage.

In the central area of the yarn passage, the width may be increased, which is useful in enabling a certain ballooning of the yarn, and to avoid or reduce frictional contact between the yarn and wall of the passage. The front surfaces can be flat or slightly curved in the traveling direction of the yarn, and/or they may be curved transversely to the traveling direction. Also, it is not necessary that the surface of each member lie entirely in one plane, and the surface may take the form of two laterally offset planes which define a shoulder therebetween.

It is possible to align several of the yarn heating chambers parallel to each other and to interconnect them by a single supply line for the heating vapor, particularly saturated water vapor. Throttling losses between the yarn ducts are largely avoided, and a good stability of the obtained yarn temperatures is insured from one yarn path to another.

Where the width of the yarn passage measures about 0.2 to 0.3 mm, and about 60 mm in length, a 167 dtex yarn may be treated with a saturated water vapor having a temperature of 220° C. and a pressure of about 24 bar, without damaging wall friction.

In the operation of prior known heating chambers which utilize saturated water vapor, it has been found that stable operation is not possible. In particular, temperature fluctuations occurred which results in a non-uniform heating of the traveling yarn. These temperature fluctuations were under certain circumstances accompanied by explosion-like discharges of saturated vapor, which interfered with the yarn path.

The present invention makes it possible to avoid this difficulty of instability, for a wide range of operating conditions. This advantage is made possible by applying adequate biasing pressure forces between the opposing front surfaces of the two members, so as to avoid large losses of saturated water vapor or a large pressure drop of the vapor.

A further advantage of the present invention resides in the fact that at least one of the members is supplied with the hot pressurized vapor on both its front and back sides in a defined surface area, which results not only in the contact pressure, but also in a heating of the member on both sides. In this regard, it has been found that due to its narrow width, the yarn passage has such a small surface that the amount of heat necessary to heat the heating chamber and to equalize the heat losses cannot be transferred via this surface. However, the provision of an additional surface on the rear side, which is heated with the same vapor and receives the same pressure, not only serves to equalize the heat losses but also renders the temperature uniform over the cross section of the heating chamber.

The above feature of the present invention is particularly advantageous for an embodiment wherein the heating chamber comprises an outer rigid member which surrounds an inner member like a jacket. However, the chamber may take the form of a rigid housing having a U-shaped cross section, which accommodates between its parallel flanks one or several plates stacked on top of each other, with the yarn passage formed between the plates and/or between one plate and one inner surface of the housing. In this case, the contact pressure zone receiving the saturated vapor simultaneously serves to heat the housing. Also, the present invention permits the inner and outer members to be manufactured with less critical tolerances. In the absence of the present invention, it is necessary to avoid any play between the inner and outer members, since any play can lead to leakage, and it also adversely effects the heat transfer from the inner member to the outer member. According to the present invention, heat is transfered by the direct contact between the inner member and the outer member, and in areas where no direct contact occurs due to manufacturing tolerances or play, heat transfer occurs by the condensation of the saturated vapor on the walls of both the inner and the outer members. Thus it is insured that the inner and the outer members are heated at the same temperature, without requiring any special arrangement therefore. The resulting improvements in stability establishes the theory that any local formation of a condensate, for example in the form of droplets, becomes noticeable during the heating and operation of the heating chamber by considerable temperature changes. In contrast thereto, undue heating leads to the fact that the saturated vapor is heated, at a predetermined pressure, above the boiling temperature of the water.

Within the scope of the present invention, it is possible that the rear surface upon which the hot pressurized vapor acts may be the same size as the mating surfaces which form the yarn passage. In such case, the pressure forces exerted between the mating front surfaces and on the rear surface are balanced, so that the member between these two surfaces floats. However, it is preferred that the rear surface be greater than the front surfaces, so that the mating front surfaces need not be pressed against each other by additional elements. The heating chamber of the present invention can be formed between two plates, each of which has an identical shoulder, with the yarn being enclosed by the shoulders. In this case, the saturated water vapor exerts a force in a direction perpendicular to the shoulders, and for this reason, the force exerted by the rear pressure surface should cause a frictional force which is greater than the opening force acting between the shoulders.

It is important for a temperature stable operation, that the two members forming the heating chamber have an essentially identical temperature in the area of the yarn passage. Therefore, heat transfer is not limited to the narrow yarn passage in the present invention, but rather, sealing strips are arranged on opposite sides of and along the yarn duct, with the sealing strips being spaced apart to define a heating enclosure which includes the yarn passage. The sealing strips are preferably inserted into grooves, and slightly project beyond the surface within the range of their elasticity. Thus when the mating surfaces are pressed against each other by the biasing force as described above, the surfaces either essentially contact each other or form a narrow separating gap, into which the saturated vapor enters and uniformly heats both mating surfaces. The advantage of this arrangement is the fact that a defined heating zone on both sides of the yarn passage is created in this separating gap. Since the surface of the yarn passage itself is not sufficient to transfer the heat which is necessary to heat the chamber, the heating zone surrounding the yarn duct permits the direct heating of the material adjacent the passage. This is accomplished on the one hand in that the saturated vapor can penetrate into the separating gap between the mating surfaces, where it condenses and transfers its heat on condensation via that portion of the mating surfaces enclosed by the sealing strips. Thus the present invention provides a defined heating of the two mating front surfaces, as well as heating on the back side of at least one of the members. This is particularly advantageous, when one of the members is in the form of a surrouding sleeve or jacket, and when the inner member accommodates on one side the yarn groove, and a rear side serving as the contact pressure zone. This results in a surface heating of both the inner and outer members at two locations.

In accordance with the present invention, additional heating areas may be formed in one or both of the two members which form the heating chamber. In this regard, it is desirable to keep the temperature gradient low within the heating system, and this object is further enhanced where at least one of the two members, and preferably the immobile member, is provided with a preneating duct which preferably extends along the heating chamber and which is supplied with the hot pressurized vapor. For this purpose, the heating chamber can be connected to a generator of saturated water vapor, so that the vapor first enters the preheating duct and then passes into the yarn passage and also into the rear pressure zone.

In order to also heat the preheating duct when the heating chamber is opened, a valve may be provided between the preheating duct and the yarn passage. In this regard, it is useful that after opening and closing the heating chamber, pressure is again applied to the opposite rear surface before the valve to the heating passage reopens and the saturated vapor enters into the yarn passage.

In a preferred embodiment, the preheating duct receives the saturated vapor at its upper portion. However, it should be noted that the preheating duct may extend obliquely or vertically. Similarly, the drain line between the preheating duct and the heating chamber may be positioned in the upper portion of the preheating duct. This arrangement provides an area below the supply line and the drain line, into which condensates and noncondensible vapors as well as air may accumulate. These accumulations prevent the lower portion of the preheating duct from being heated to the temperature of condensation of the saturated vapor under a given pressure, and to avoid this disadvantage, the lower portion of the preheating duct may be equipped with a drain, gate, or other valve system for draining condensed water, air, inert gases, etc. The drain is preferably connected with a condensate collecting tank. The use of shutters and narrow gaps in the drain is disadvantageous in that they not only restrict the passage of vapor, but also the passage of gases so that under certain circumstances noncondensible gases, such as air, cannot be removed at the rate at which these gases accumulate. In addition, saturated vapor can escape through such shutters and narrow gaps. In order to permit only fluid and inert gases to escape, but not saturated vapor, it is possible to use a temperature controlled condensate separator. Known separators however exhibit a substantial response time, so that their accuracy to respond is essentially greater than 1° K. A condensate separator, which possesses a freely movable plate in its separating chamber has been found to handle the function of separating the condensates in an excellent manner. In one position, the plate closes the openings which are arranged in a common plane, ano which lead to the preheating duct and to an external condensate collecting tank. In its other position, the freely movable plate lies below and parallel to these openings so that when saturated vapor flows from the preheating duct via the connecting duct and to the separating chamber, it has a high exit speed so that there is a reduced static pressure on the upper side of the plate as compared to its underside. The underside of the plate is held at a distance from the bottom of the separating chamber by means of suitable spacers, and the pressure difference pushes the plate against the two openings and closes the same. When now condensates or other inert gases accumulate in the lower portion of the preheating duct, the temperature drops slightly in the lower portion of the duct and also in the separating chamber, so that the static pressure in the separating chamber becomes lower than the static pressure in the preheating duct. As a result, the plate falls by gravity from the openings. The outflowing condensates have such a low velocity that the static pressure on the upper side of the plate remains unchanged. The outflowing gases, however, have a high velocity, due to their lower temperature, and the pressure in the separating chamber will remain lower than the static pressure in the preheating duct.

A further advantage of such preheating ducts is the fact that they enlarge the contact surface for heat transfer from the saturated water vapor to the heating chamber.

It is a further aspect of the present invention that additional heating zones are provided in the separating gap between the mating front faces of the two members, which do not effect a contact pressure between the surfaces, in contrast to the parallel rear pressure zone.

The heat transfered to the heating chamber is further aided in that the surface discontinuity which forms the yarn passage, for example the yarn guide groove, may be formed in an insert which is positioned in a channel formed in one of the members of the heating chamber. The insert is adapted to receive the saturated vapor on its rear side, and with the area on its rear side preferably being greater than the sealing area on the front surface of the insert, and so that the insert is biased against the mating front surface of the other member. In another embodiment, the sealing areas on the front and back sides of the inserts are identical. However, the fact that a dynamic current on the front surface of the insert results in less static pressure than on the rear side of the insert, and provides a contact pressure. Further, such inserts are advantageous in that they can be made of a relatively wear resistant material, and they can easily be replaced, when worn, or when the denier of the yarn is changed.

Some of the objects and advantages of the present invention having been stated, others will appear as the description proceeds when taken in conjunction with the accompanying drawings, in which FIG. 1 is a sectional side elevation view of a yarn heating chamber which embodies the features of the present invention;

Figure 12:
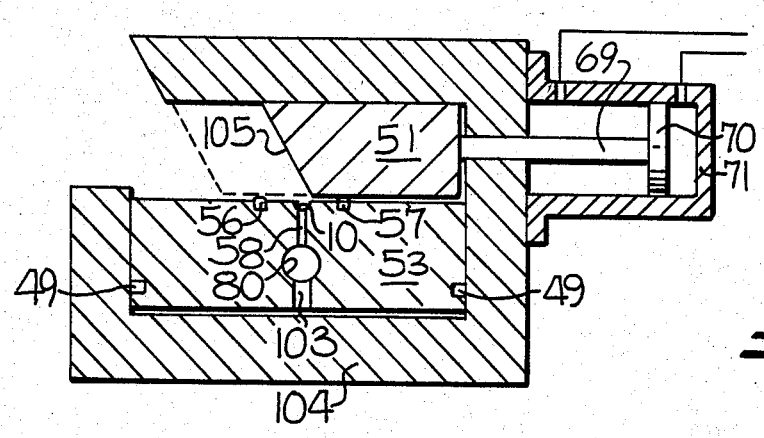
Figure 13:
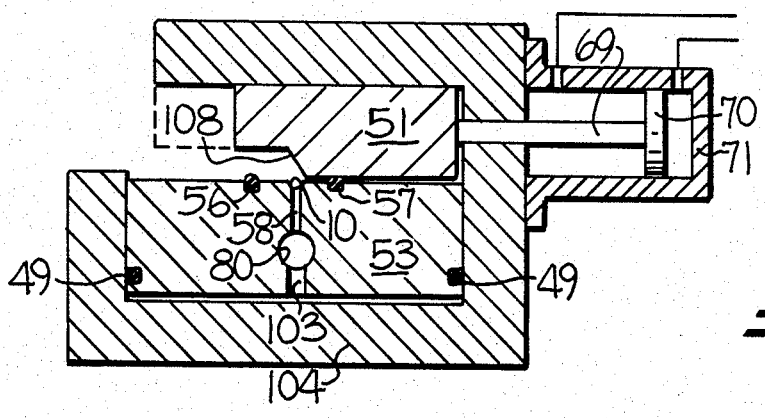
Figure 14:
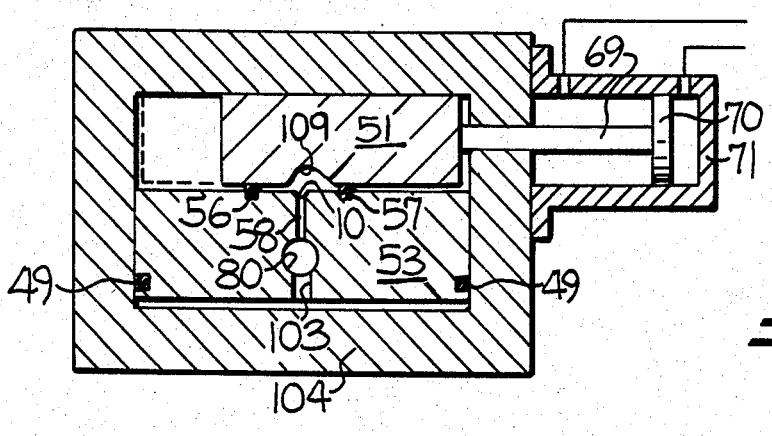
Figure 15A:
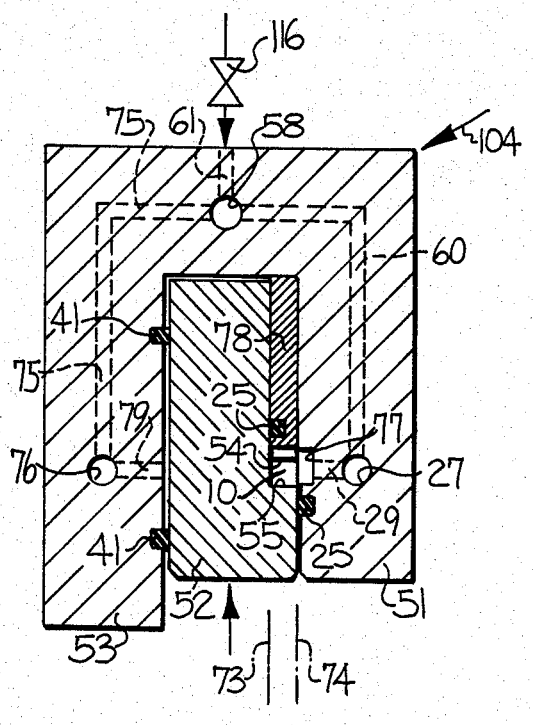
Figure 15B:
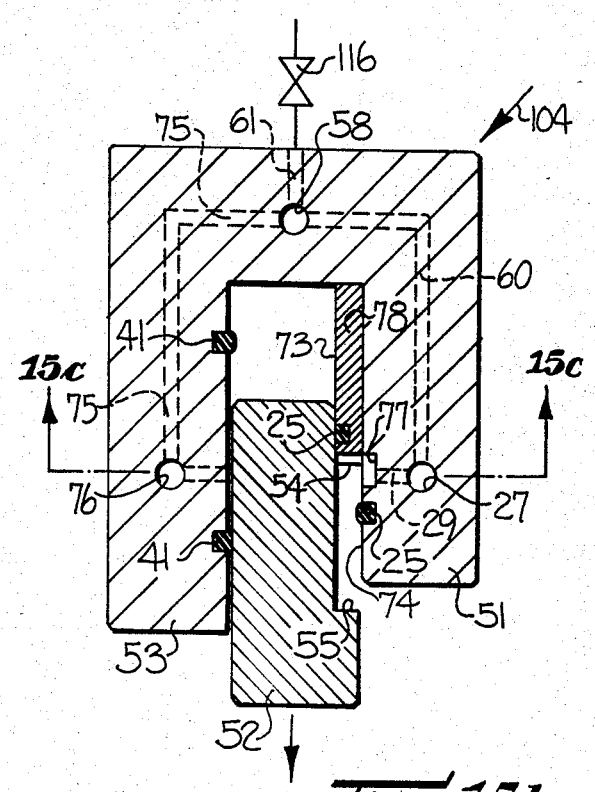
Figure 15C:
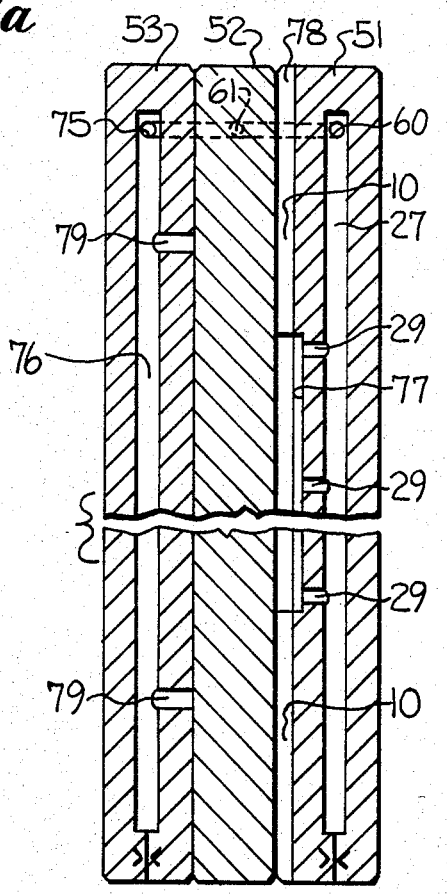

FIGS. 12–14 each illustrate an additional embodiment of the present invention;

FIGS. 15*a* and 15*b* illustrate still another embodiment of the invention, with FIG. 15*a* illustrating the operative position and FIG. 15*b* illustrating the threading position;

FIG. 15*c* is a view taken substantially along the line 15*c*—15*c* of FIG. 15*b;*

Figure 1:
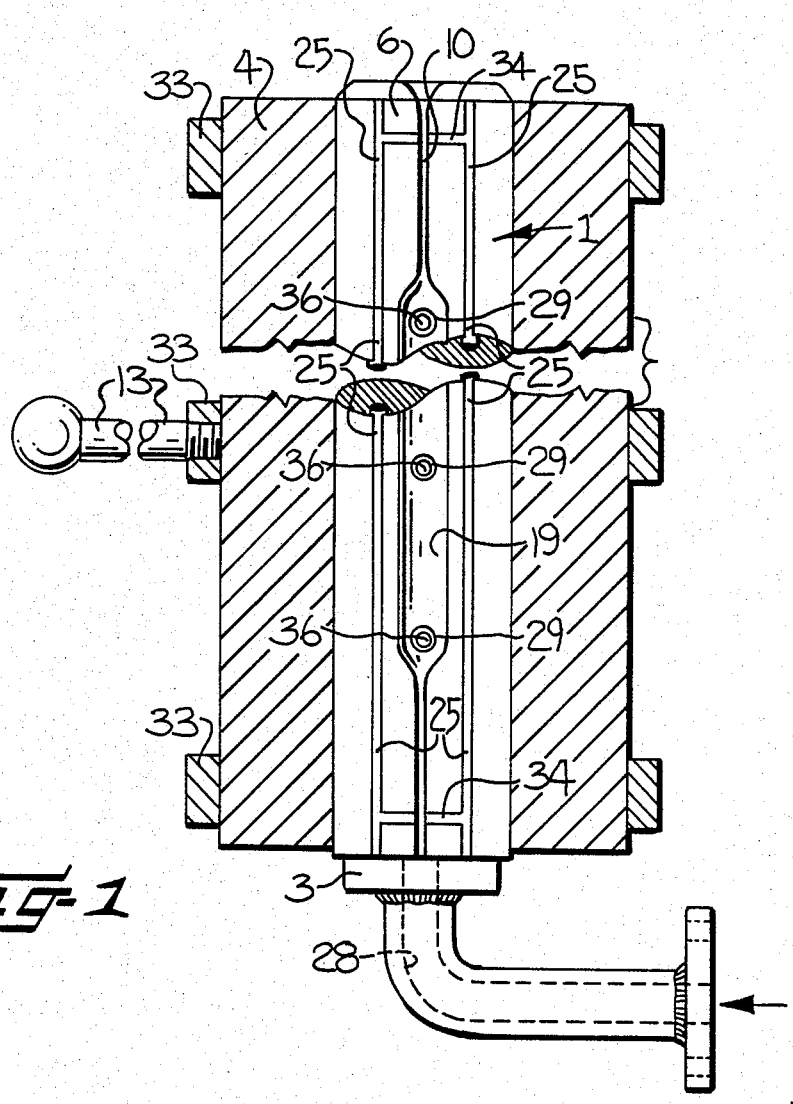
Figure 2:
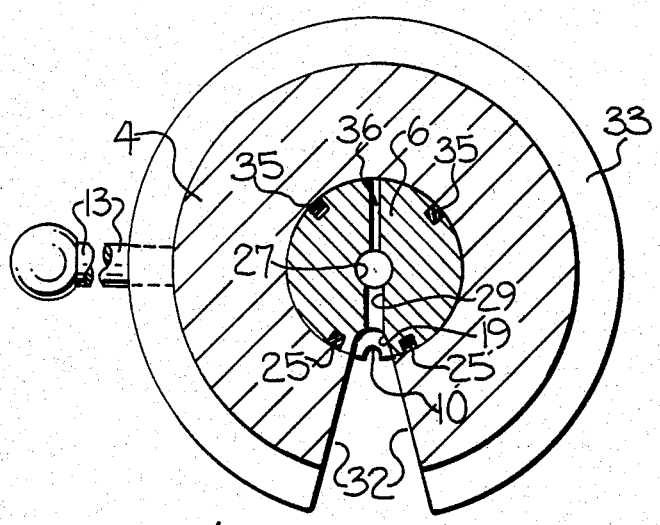
FIG. 2 is a sectional view of the chamber shown in FIG. 1, and illustrated in the threading position.
Figure 3:
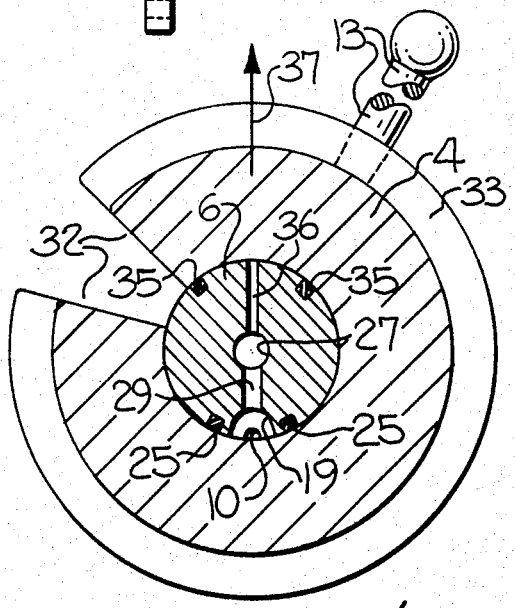
FIG. 3 is a view similar to FIG. 2 but illustrating the chamber in the operative position.

Referring more particularly to the drawings, FIGS. 1–3 illustrate a heating chamber which embodies the features of the present invention, and which comprises an outer tubular sleeve 4 having a generally cylindrical internal bore, and a cylindrical inner member 6 disposed coaxially in the bore of the sleeve. The inner member 6 is fixedly attached to a transverse flange 3, and the outer sleeve 4 is adapted to rotate relative to the inner member by means of the attached handle 13. A yarn guide groove 10 extends along the entire length of the inner member 6, and in its central area 19, the yarn guide groove widens in the circumferential direction and in its depth, so that a widened yarn passage is created in this area in which the yarn can move, fluctuate or balloon without contacting the walls.

A pair of sealing strips 25 are mounted on the inner member 6, with the sealing strips being disposed on respective opposite sides of the groove 10 and extending longitudinally along substantially the entire length thereof. The sealing strips 25 seal the yarn passage in the circumferential direction, and in addition to these strips, there is further provided a transverse sealing strip 34 adjacent each of the yarn inlet and the yarn outlet. These transverse sealing strips extend between the longitudinal strips and such that the transverse strips substantially close the ends of the heating enclosure defined within the boundary of the strips 25 and 34. The transverse sealing strips may be O-shaped, and extend only between the longitudinal strips, but the transverse strips may alternatively be an O-ring which entirely surrounds the inner member 6. The longitudinal and transverse sealing strips are inserted into grooves provided in the inner member, with the depth of the grooves being less than the thickness of the sealing strips. The contact pressure force exerted by the rigid outer sleeve presses the sealing strips so that they seal the separating gap between the mating surfaces of the sleeve and inner member in a heating enclosure which is defined by the strips and surrounds the yarn passage.

The inner member 6 has a central bore or duct 27, which is closed at its upper end and communicates with a connecting tube 28 at its lower end. The connecting tube 28 supplies the duct 27 with saturated water vapor under pressure, and the duct 27 is in turn connected with the yarn guide groove 10 in its central area 19, via radial ducts 29. The water vapor may thus exit through the ducts 29 into the widened central area 19 of the yarn guide groove 10.

The sleeve 6 includes a slot 32 for inserting the yarn, but alternatively, the sleeve 4 may include an axially extending groove formed in the inner surface of the bore thereof, and which extends along at least each end portion of the bore. Such groove may be provided with sides which gently slope from the bottom of the groove to the surface of the bore. Also, bands 33 are provided which surround the outer sleeve 4 for increased strength. By actuating the handle 13, the outer sleeve 4 can be rotated between a threading position wherein the groove 10 in the inner member is aligned with the slot 32 in the outer sleeve (note FIG. 2), and an operative position wherein the groove 10 of the inner member is circumferentially offset from the slot 32 and only the groove 10 in the inner member forms the yarn receiving passage (note FIG. 3). In the threading position, a running yarn may thus be inserted laterally into the groove 10, and it will be understood that the slot may extend in the direction of a secant or a tangent, rather than in the radial direction as illustrated. Also, it will be noted that in the operating position, the yarn guide groove 10 is reduced to a very narrow yarn passage by the inner wall of the bore of the outer sleeve 4, which prevents large quantities of the hot pressurize vapor from escaping. In the end areas of the heating chamber, the gap width of the yarn duct is on the order of less than about 0.5 mm, and the particular size of the duct is adapted to the number and denier of the yarns treated in the duct. As a specific example, where a gap measuring about 0.2 to 0.3 mm wide and a gap length of only 60 mm, a 167 dtex yarn can be treated with saturated water vapor, without damaging wall friction, and with only small losses of vapor at the yarn inlet and the yarn outlet. The temperature of the vapor in the above example may be about 220° C. corresponding to a pressure of about 24 bar.

Viewing FIGS. 2 and 3, it will be seen that the inner member 6 includes a rear surface portion which faces opposite from that portion of its exterior surface immediately adjacent the groove 10. This rear surface portion is defined between the longitudinal sealing strips 35 as well as transverse seals which are not shown but which correspond to the transverse sealing strips 34 on the front side, and which are arranged at both the yarn inlet and the yarn outlet. The surface between these longitudinal sealing strips 35 and their transverse sealing strips receives the saturated water vapor from the duct 27 via radial duct 36. Since the secantial distance between the longitudinal sealings strips 35 on the rear side of the inner member 6 is greater than the secantial distance of the sealing strips 25 on the front side, the vapor pressure acts to bias the outer sleeve 4 against the longitudinal seals 25 on the front side in the direction of the arrow 37. Thus, a cushion of saturated vapor develops on the rear side of the inner member 6 in the separating gap between the inner member and the outer sleeve and there is formed a contact pressure zone having an area which is greater than the heating enclosure on the front side of the member 6. This results in the advantage that a well defined contact pressure force becomes operative between the inner and outer members in the area of the yarn passage and the sealing strips 25, and in addition the rear side of the inner member and the adjacent portion of the outer sleeve 4 is directly heated by the saturated water vapor, so that the heating temperature of the contact pressure zone on the rear side is the same as the temperature adjacent the passage 10 on the front side.

Figure 4:
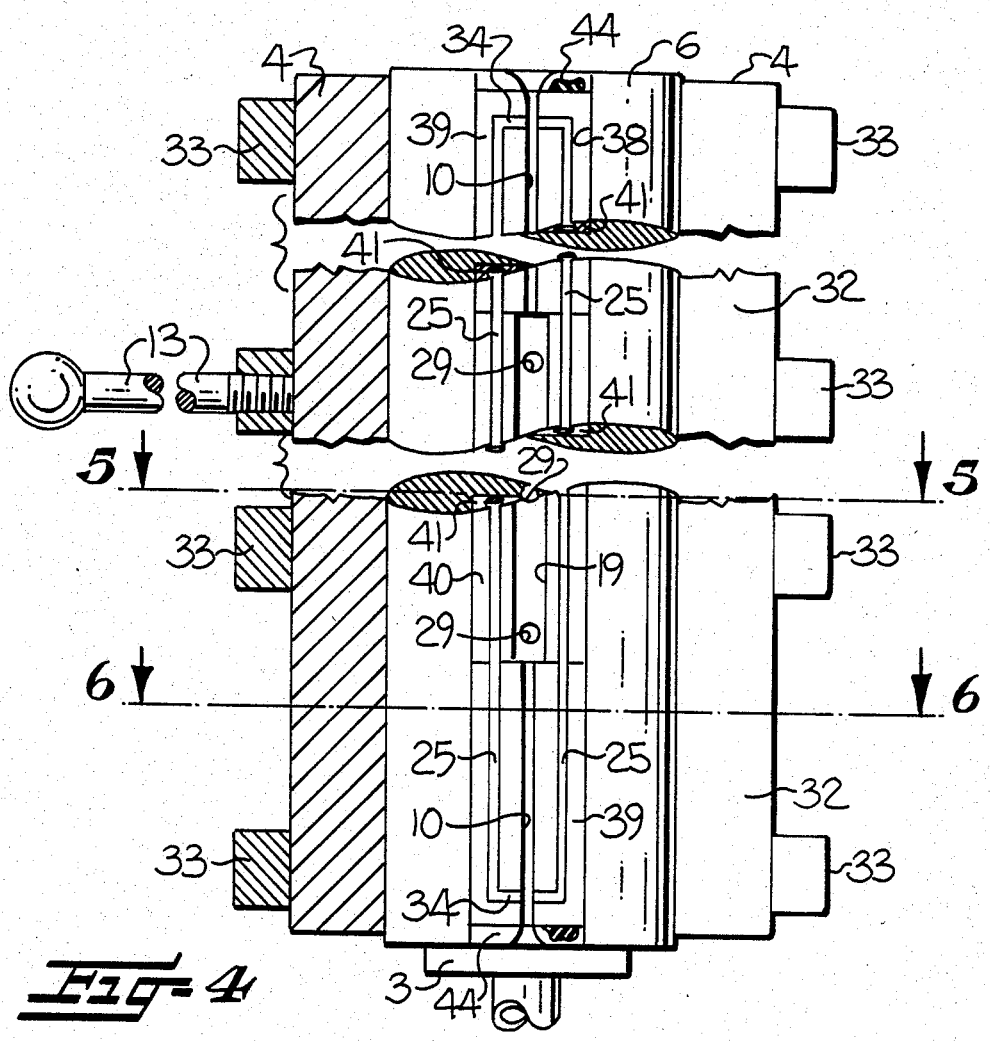
FIG. 4 is a sectional side elevation view of a further embodiment of the present invention.
Figure 5:
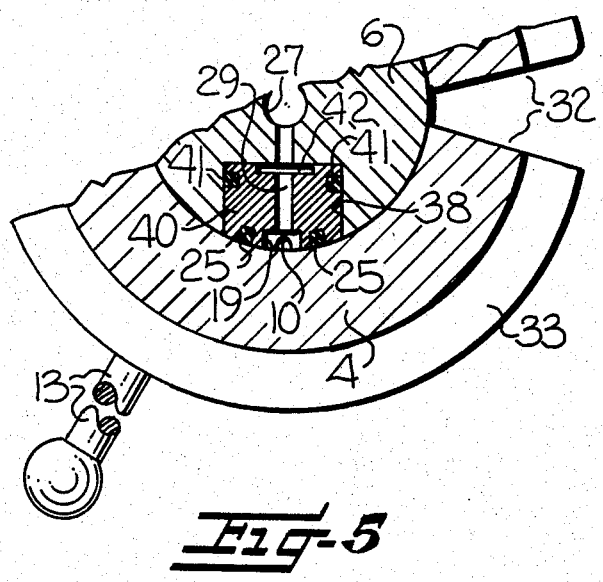
FIG. 5 is a fragmentary sectional view taken substantially along the line 5—5 of FIG. 4.
Figure 6:
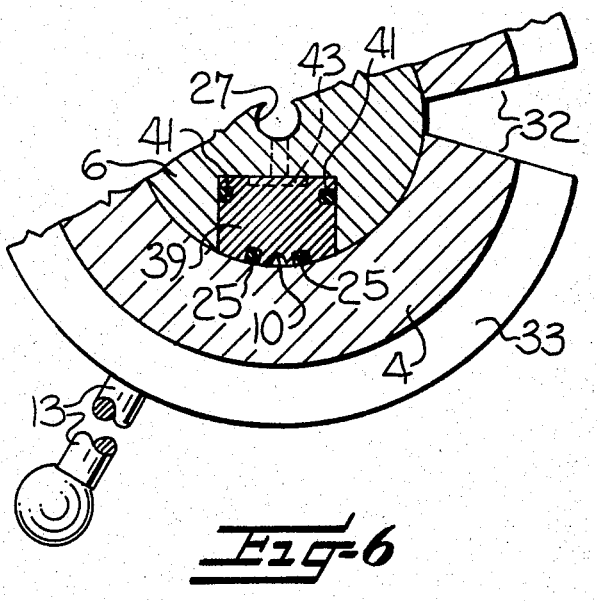
FIG. 6 is a view similar to FIG. 5 and taken substantially along the line 6—6 of FIG. 4.

In the embodiments shown in FIGS. 4–6, the inner member 6 is again in the form of a cylinder which is fixedly attached to the flange 3, and the outer sleeve 4 is again designed as a rotatable jacket provided with a yarn inserting slot 32. The slot 32 terminates in the threading position (not shown) in alignment with the yarn guide groove 10, and in the operative position shown in FIGS. 5 and 6, the sleeve 4 covers the yarn guide groove.

A continuous channel 38 extends axially along the entire length of the inner member 6, and the channel preferably is of the same width and depth over its entire length. Inserts 39 and 40 are mounted in the channel 38, with the inserts 39 forming the yarn inlet and yarn outlet portions and including a narrow yarn guide groove 10, as shown in FIGS. 4 and 6. The insert 40 is located in the central area 19 of the heating chamber, and includes a yarn groove with a widened cross section, note specifically FIG. 5. Longitudinal sealing strips 25 seal the inserts 39 and 40 over their entire length on both sides of the groove. In addition, as already noted with respect to the embodiment of FIG. 1, transverse seals 34 are arranged on the inserts 39. The sealing strips 41 seal the sides of the inserts with respect to the sides of the groove 38, and to provide a certain degree of mobility, the sides of the channel and of the inserts are aligned parallel to each other.

Each of the inserts includes an outer surface facing the bore of the sleeve and which includes the groove 10 formed therein, and each insert further includes an oppositely facing inner surface which is disposed against the bottom wall of the channel 38. The insert 40 has a longitudinal groove 42 formed in its inner surface, and through which the duct 29 extends for connecting the groove 10 with the bore 27. Since the secantial distance between the sealing strips 25 on the outer surface of the inserts 40 is less than the secantial distance between the sealing strips 41, the vapor pressure acting on the inner or rear surface of the insert acts to press the insert against the bore of the sleeve.

The inserts 39 at the yarn inlet and the yarn outlet need not be provided with a longitudinal groove 43 to which the vapor pressure is applied, and as shown in dashed lines in FIG. 6. Similarly, it is not absolutely necessary that a separate vapor duct be provided for supplying the longitudinal groove 43 with vapor. Rather, the vapor pressure existing in the longitudinal groove 42 of the insert 40 will provide an adequate pressure along the inner surface of the inserts 39. Even with the groove 43 being absent, or extending only a short distance from the insert 40 toward the yarn inlet, or respectively the yarn outlet, the static vapor pressure formed rearwardly of the insert 39 suffices to provide an adequate contact pressure for the sealing strips 25 against the inner bore of the sleeve 4. It should also be noted that in the area of the yarn inlet and yarn outlet, a current develops in the yarn passage resulting in a pressure drop, so that the static pressure on the rear side of the inserts 39 is greater than the static pressure on their front side. Thus also in the case of the inserts 39, the sealing strips 41 insure that the rear side is sealed, and as is shown in FIG. 4, flat sealing plates 44 are provided which are firmly fixed in the bore of the sleeve 4 and sealed, to seal the end faces of the inner member 6.

Figure 7:
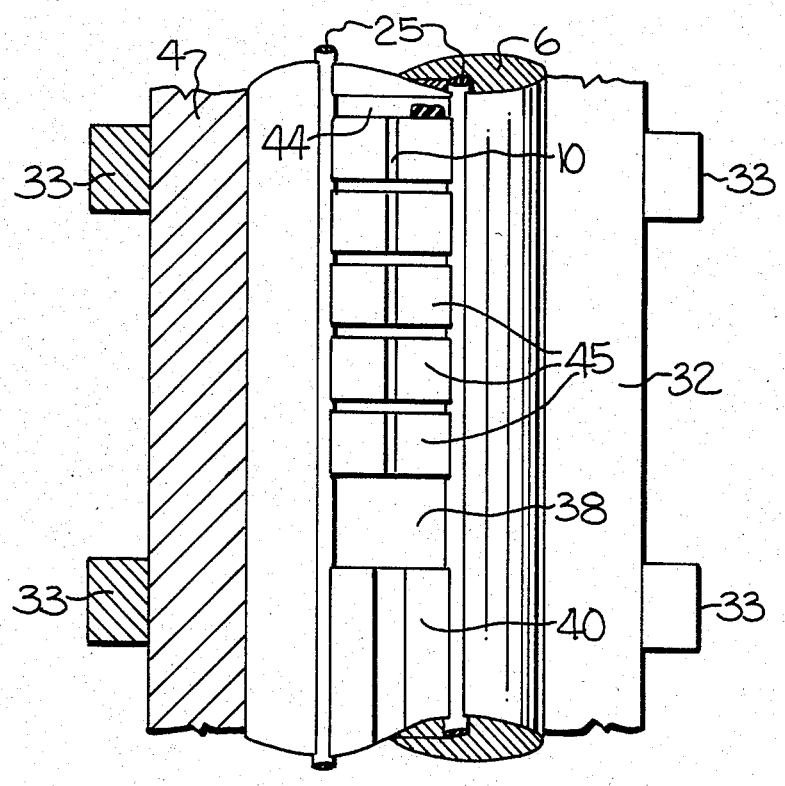
FIG. 7 is a fragmentary sectional side elevation view of still another embodiment of the present invention.
Figure 8:
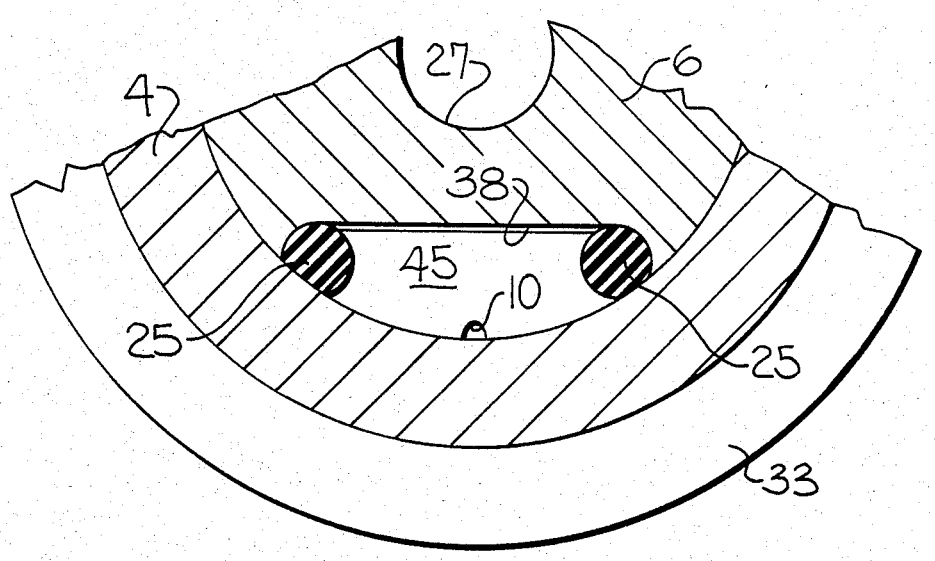
FIG. 8 is a fragmentary sectional view of the embodiment shown in FIG. 7.

In the embodiment of FIGS. 7 and 8, each of the yarn inlet and the yarn outlet portions of the heating chamber are formed by a plurality of relatively thin inserts 45. For this purpose, the inner member 6 includes a axial insert groove 38, and the sides of the insert groove 38 are arcuately curved so that they support the sealing strips 25, note particularly FIG. 8.

In its central area, the heating chamber of FIGS. 7 and 8 can also consist of an insert 40. However, this insert may be omitted, or replaced with several individual, shorter inserts. The inserts 45 and 40 include sides which are adapted to the sealing strips 25, and which permits the inserts to be clamped between the strips 25. Since the sealing strips are laterally spaced apart, a static pressure will develop behind the strips, while a current with a corresponding decrease in the static pressure will form at the front of the strips. For this reason, the sealing strips are again pressed forwardly against the inner surface of the sleeve 4, even though the size of the heating zone on the front of the inserts is the same as the size of the contact pressure zone on the rear side of the inserts.

In the embodiments of FIGS. 4–8, the inserts may comprise a wear resistant material, such as ceramic, and in particular, sintered ceramic or sintered metal. The advantage of this embodiment is that the inserts may be easily removed when worn, or when the denier of the yarn to be processed is changed. Further, these inserts can easily be mass produced and it is less costly to form a wide channel in the inner member 6 than a very fine yarn guide groove. Still further, due to their vapor heated rear side, the inserts insure that the area of the heating chamber surrounding the yarn passage is heated to a temperature which essentially corresponds to the operating temperature in the yarn passage. This effect is enhanced by the heating zones which are formed on the front side of the insert between the sealing strips 25, since in this heating zone the heat is also transferred to the sleeve 4.

Figure 9:
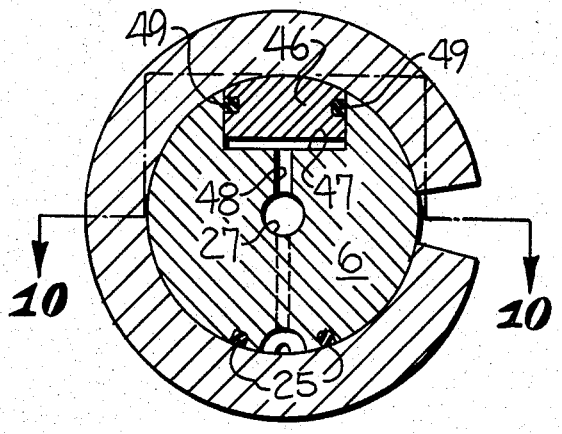
FIG. 9 is a fragmentary sectional view of a further embodiment of the present invention.
Figure 10:
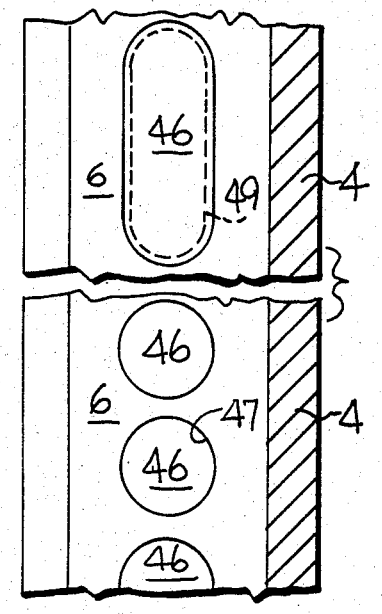
FIG. 10 is a fragmentary sectional view illustrating two possible constructions for the embodiment of FIG. 9.

In the embodiments of FIGS. 9 and 10, the inner member 6 includes an axially extending channel 47 formed in the exterior surface thereof on the side opposite the groove 10. The channel has a flat bottom wall and parallel opposite side walls, and metallic inserts 46 are positioned in the channel 47, with the inserts 46 including an outer surface facing the bore of the sleeve and an oppositely facing innner surface which overlies the bottom wall of the channel. A bore 48 extends from the duct 27 into communication with the bottom wall of the channel 47, so that a portion of the hot pressurized vapor is conducted into the area between the bottom wall of the channel and the inner surface of each of the inserts. Here again, longitudinal seals 49 are provided which seal the sides of the inserts against the sides of the channel. Also, it is preferred that corresponding transverse seals are also present, which are not shown in the drawings. Depending on the ratio of the surface area, which is defined on the front side of the inner member 6 by the sealing strips 25 and the corresponding transverse seals, to the area defined by the sealing strips 49 and the corresponding transverse seals, the inserts 46 may extend over a substantial portion of the length of the inner member 6. As shown in the upper portion of FIG. 10, the insert 46 extends over a partial length and has a cross section in the shape of an oval, and so that an annular O-ring can be used as the longitudinal and transverse seal. As an alternative, and as is shown in the partial illustration in the lower portion of FIG. 10, the insert channel 47 and the insert 46 may be cylindrical. In these embodiments, the outer sleeve is heated by the metallic contact between the insert 46 and the bore of the sleeve in a large contact surface, which is greater than the heating area on the front side of the inner member.

Figure 11:
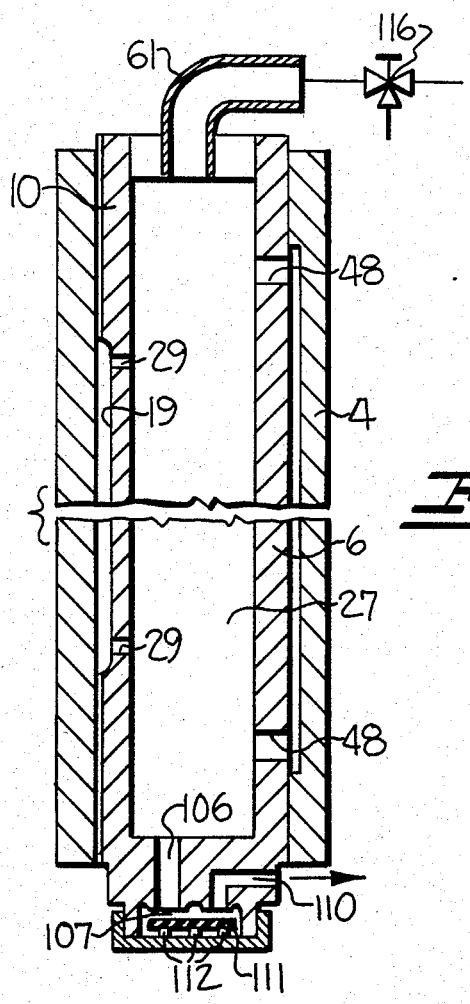
FIG. 11 is a sectional side elevation view of an embodiment of the present invention and which illustrates a vapor supply duct and condensate removal valve.

Referring to FIG. 11, there is illustrated a heating chamber which consists of a tubular inner member 6 and a sleeve 4 mounted thereabout. The constructional details of this embodiment are generally similar to those described above with respect to FIGS. 1–10. However, a groove 43 is provided on the rear side of the inner member 6 which is preferably at least as long as the central area 19 wherein the yarn passage is widened. The upper end of the groove connects to the preheating duct 27 via a bore 36. The condensate can flow through bore 50 from the groove 43 back to the preheating duct 27. The groove 43 defines a contact pressure zone, which is greater in area than that of the heating zone defined adjacent the yarn passage. The preheating duct, which is formed by the interior of the member 6, receives the vapor from the vapor line 28 at its upper end, and the ducts 29 permits the saturated vapor to enter into the central area 19 from the preheating duct 27. A receptacle is thus formed in the lower portion of the preheating duct, into which the condensate and also inert gases, i.e., gases and vapors which do not condense at the given pressure and temperature conditions, and which are heavier than the saturated vapor, may accumulate. The condensates, in particular the condensed water and inert gases, have a temperatur which is below the temperature of the saturated vapor. At its lower end, the preheating duct is provided with an opening 106, which terminates in a separating chamber 107. Another opening 110 of the separating chamber leads to the exterior or to a condensate collection tank, which is not shown. The lower ends of the openings 106 and 110 are arranged in a common plane, and a plate 111 is provided which rests on the bottom of the separating chamber and which is freely movable, although it may be supported by a weak spring. It is significant that the plate extends essentially parallel to the plane of the lower ends of the openings 106, 110, and is only slightly spaced therefrom. Spacers 112 are arranged on the underside of the plate, which cause the static pressure in the separating chamber 107 to also become operative on the underside of the plate.

When the chamber is heated, condensates first accumulate in the lower receptacle of the preheating chamber 27. These condensates are transported through the opening 106, separating chamber 107, and opening 110 to the condensate collection tank. Upon completion of heating, only a small amount of condensate accumulates, so that the saturated vapor starts to flow through the openings 106 and 110. As it does so, the stream of saturated vapor contacts plate 111, and flows at a high velocity toward opening 110. Due to this high velocity, the static pressure on the upper side of the plate falls, while the pressure is maintained on the underside of the plate. As a result, the plate is lifted against the two openings 106 and 110 and closes the separating chamber 107, so that the static pressure is maintained therein. Since the closing surface on the openings 106 is smaller than on the underside of the plate 111, and since only atmospheric pressure exists at the opening 110, the plates will rest firmly in front of the opening 106.

The above condition remains as long as the temperature in the separating chamber 107 is maintained. When the condensate and inert gases again accumulate in the lower receptacle of the preheating chamber 27, the temperature will drop. Thus the pressure in the separating chamber 107 also drops, since the chamber 107 follows the same temperature fluctuations as the preheating duct by reason of their direct heat conductive connection. By reason of the developing overpressure at the opening 106, the plate first exposes the opening 106, which causes the plate to cant relative to the opening 110. Thereby, the pressure in the separating chamber decreases, and the plate 111 drops to the bottom, so that now the condensate or inert gases can escape. In the illustrated embodiment, the plate 111 is adapted to move against gravity in the vertical direction, but it is also possible to guide the plate horizontally or pivotally and/or to replace the force of gravity by a spring or the like.

The vapor is supplied to the preheating duct 27 via the connecting line 28 and three-way valve 116. This valve alternately supplies vapor to the preheating duct 27, or releases the duct. When the preheating duct is released, the contact pressure zone on the rear side of the inner member 6 is also released, so that the outer sleeve 4 can readily be rotated relative to the inner member 6 to the threading position.

Referring now to FIG. 12, there is illustrated a further embodiment of the present invention which comprises a first elongate plate 52 having a generally flat front surface which faces upwardly in the illustrated embodiment, and a rear surface which faces in the opposite or downward direction. A second elongate plate 51 is provided which also has a generally flat front surface, and the two plates are mounted with the front surfaces thereof in an overlying relationship and for movement along a direction which is generally parallel to the front surfaces and transverse to the direction of the groove 10 in the front surface of member 52, and between an operative position shown in dashed lines and wherein the front surface of the member 51 overlies the groove 10 in the front surface of the member 52 to define a relatively narrow yarn passage, and a threading position shown in solid lines wherein the front surface 105 of the member 51 is withdrawn from the groove 10. The two plates are surrounded by a solid housing 104, which is formed of plates 64, 65, and 66, which may be bolted together and which is sufficiently strong to absorb the pressures developed in the interior of the yarn passage, and the forces created thereby. The plates 51 and 52 are movable in the described manner by means of a cylinder-piston assembly 69, 70, and 71.

In the threading position, the front edge 105 of the plate 51 is withdrawn from the yarn guide groove 10, so that an opening is formed through which the yarn can be laterally threaded. In the operating position, saturated vapor is supplied to the yarn guide duct 10 by a valve (not shown) and via a preheating duct 27 which extends longitudinally along the plate 52. A duct 29 extends from the duct 27 to the groove 10, and the rear side of the plate 52 receives the vapor through the duct 36. As a result, the plate 52, which is sealed in the housing 104 by continuous seals 41, is biased upwardly against the plate 51, so that the seals 25 on opposite sides of the groove 10 are compressed between the plates to effect a secure vapor seal. It is also noted that the surface area defined by the continuous seals 41 is greater than the surface area formed by the longitudinal seals 25 and their respective transverse seals.

FIG. 13 shows a similar embodiment, which differs from FIG. 12 only in that the front edge of the plate 51 is provided with a step 108. Similarly, the embodiment of FIG. 14 is essentially the same as FIG. 12, but differs in that the plate 51 does not withdraw from the groove 10 in the threading position. Rather, an enlarged longitudinal groove 109 is formed in the front surface of the plate 51, and in the threading position as illustrated, the groove 109 is aligned with the groove 10 and forms a widened threading slot, through which the yarn may be inserted pneumatically or by means of a threading wire. The groove 109 is inclined on one side, so that the yarn is guided along its slope and into the groove 10 when the plate is moved to its operating position as shown in dashed lines. In all of these embodiments, it is necessary that the housing 104 surrounding the plates 51 and 52 is designed firmly and rigidly enough to absorb the vapor forces and to also insure that the plates are held together with sufficient force to sealingly compress their longitudinal and transverse seals. Note that in the case of the embodiment of FIG. 14, the housing surrounds all sides of the plates 51 and 52 in cross section.

FIGS. 15*a*–15*c* are cross sectional views of still another embodiment of the present invention. In this embodiment, the chamber comprises a U-shaped outer member 104, composed of parallel side plates 51 and 53. The plate 51 has an inner or front surface which is defined by two parallel and laterally offset surfaces 73 and 74, and with a transverse shoulder 54 being formed between these surfaces and extending along the longitudinal length of the front surface. The chamber further includes an inner elongate plate 52 having a front surface which conforms to the surfaces 73 and 74, and which has a transverse shoulder 55 formed between these two surfaces and which extends along the longitudinal length of its front surface. Thus the two mating front surfaces of the plate 51 and the plate 52 are substantially congruent with each other.

The plate 53 of a U-shaped housing 104, and the inner plate 52 include opposing rear surfaces. In the illustrated embodiment, the shoulders 54 and 55 of the plates 51, 52 are each straight and of the same size. However, it is possible to design the shoulders differently, such as where the shoulders are concave in the illustrated cross sectional view. The plate 52 is slideably mounted with respect to the housing 104, and in the position shown in FIG. 15*b*, a longitudinal slot is formed between the front surfaces of the plates 51 and 52 in the area of the shoulder 55, since the shoulder 55 projects slightly beyond the lower edge of the plate 51. A yarn traveling parellel to the longitudinal slot can thus be inserted transversely to its traveling direction and into the gap between the front surfaces of the plates 51 and 52. The plate 52 may then be moved back to a position shown in FIG. 15*a*, wherein a narrow yarn duct 1 is formed by the surface 74 and shoulder 54 of the plate 51, and by the opposing surface and shoulder 55 of the plate 52. Saturated water vapor is supplied through the vapor connection 61 and a first preheating duct 58, as well as intermediate duct 60 and a second preheating duct 27, to the yarn passage 10. For this purpose, as is shown in dashed lines in FIGS. 15*a* and 15*b*, a recess 77 may be formed into the surface 74 and the shoulder 54 of the plate 51 in the area where the duct terminates. This recess provides a widening in the yarn passage over a portion of its length in the central area, so that the narrow gap remains only at the inlet and the outlet areas of the chamber.

A rear contact pressure zone is provided between the rear side of the plate 52 and the plate 53. For this purpose, an additional duct 75 leads from the first preheating duct 58 to a third preheating duct 76 having a bore 79. The separating gap between the plate 52 and 53 is laterally sealed by sealing strips 41. The area defined by the sealing strips 41 forms a rear contact pressure zone wnich is greater than the area of the heating enclosure which receives the saturated vapor and which is defined by the sealing strips 25 in the surfaces 73 and 74 of the plate 51. This results in the front surfaces of the plates 51 and 52 being biased toward each other.

It should also be noted that the preheating ducts 58, 27, and 76 preferably extend over the entire length of the yarn duct 10, and specifically over the central area thereof. The supply system which interconnects the preheating ducts for the purpose of supplying the hot pressurized vapor, is preferably arranged in an upper plane. On their bottom, the preheating ducts have condensate drains, which lead either via a condensate separator to the exterior, or to a common condensate collection tank. Vapor is supplied via a three-way valve 116, which in the operating position as shown in FIG. 15*a*, opens the vapor to the preheating ducts. When the heating chamber is moved to its threading position as shown in FIG. 15*b*, the valve 16 releases the pressure in the preheating ducts.

It should be particularly noted that, in the embodiment of FIGS. 15*a*–15*c*, the rear contact pressure zone which is defined by the sealing strips 41 on the back sides of the plate 52, must be sufficiently large that the frictional force generated by the given vapor pressure between the plates 51 and 52 is greater than the vapor force operative on the shoulder 55. Thus the plate 52 is prevented from moving by reason of the vapor pressure acting on the shoulder 55, and additional mechanical means for holding the plate 52 in its operative position need not be employed.

It should further be noted that the shoulder of one of the plates, and in particularly the stationary plate 51, can also be formed by providing the plate with a flat inner or front surface, with an intermediate plate mounted thereon, and with the thickness of the intermediate plate corresponding to the shoulder width of the other plate. This construction results in a simplified manufacture of the chamber, and such an intermediate plate is illustrated at 78 in FIGS. 15*a* and 15*b*. The plate 78 forms a shoulder 54 on the plate 51, and may be, for example, firmly bolted to the plate 51.

In the drawings and specification, there has been set forth preferred embodiments of the invention, and although specific terms are employed, they are used in a generic and descriptive sense only and not for purposes of limitation.

That which is claimed is:

1. A heating chamber for thermally processing an advancing yarn, and comprising a first member including a front surface having an elongate discontinuity therein which extends in a longitudinal direction, a second member including a front surface which is substantially congruent with said surface of said first member, at least one of said first and second members including a rear surface which faces oppositely from the associated front surface of such member, means mounting said first and second members for relative movement between an operative heating position wherein the respective front surfaces overlie each other and said discontinuity defines a relatively narrow passage therebetween for the yarn, and a threading position wherein said front surface of said second member is positioned relative to said discontinuity to define an enlarged opening to facilitate threading of the yarn, heating duct means for introducing a hot pressurized vapor into said yarn passage when said members are in the operative position, and resilient biasing means for applying a force upon said rear surface when said members are in the operative position, and so as to bias said front surfaces toward each other.

2. The heating chamber as defined in claim 1 wherein said biasing means comprises means for conducting a pressurized fluid into operative contact with said rear surface.

3. The heating chamber as defined in claim 2 wherein said means for conducting a pressurized fluid into contact with said rear surface includes secondary duct means communicating with said heating duct means so that a portion of the hot pressurized vapor supplied by said heating duct means is directed into contact with said rear surface.

4. The heating chamber as defined in claim 3 further comprising a pair of sealing strips mounted on at least one of said front surfaces of said first and second members, said sealing strips being disposed on respective opposite sides of said discontinuity and extending longitudinally along substantially the entire length thereof and so that in said operating position said sealing strips are sealably disposed between said front surfaces, and said front surfaces and said sealing strips define a heating enclosure which includes said discontinuity, and whereby the hot pressurized vapor introduced by said heating duct means is adapted to directly contact and heat the portions of the front surfaces lying between said sealing strips to thereby achieve substantial heat transfer.

5. The heating chamber as defined in claim 4 further comprising a transverse sealing strip mounted on said at least one of said front surfaces and adjacent each end of said discontinuity, with each transverse sealing strip extending substantially between said longitudinal sealing strips, and such that said transverse sealing strips substantially close the ends of said heating enclosure.

6. The heating chamber as defined in claim 5 wherein said rear surface includes a pair of longitudinally extending sealing strips which are laterally spaced apart a distance greater than that of said first mentioned longitudinal sealing strips.

7. A heating chamber for thermally processing an advancing yarn, and comprising an outer tubular sleeve having a generally cylindrical internal bore, and an axially extending groove formed in the inner surface of said bore along at least one end portion of said bore, a cylindrical inner member disposed coaxially in said bore of said outer sleeve, with said inner member having an axial length at least substantially corresponding to that of said bore, and an axially extending groove formed in the exterior surface of said inner member along the entire axial length thereof, said inner member including a rear surface which faces opposite from that portion of the exterior surface of said inner member immediately adjacent said groove, mounting means for permitting relative rotational movement of said inner member relative to said outer sleeve so as to be movable between an operative position wherein the grooves are circumferentially offset and only the groove in said inner member forms the yarn receiving passage, and a threading position wherein the grooves are aligned with each other to form an enlarged threading opening, heating duct means for introducing a hot pressurized vapor into said yarn passage when said members are in the operative position, and means for conducting a pressurized fluid into contact with said rear surface when said members are in the operative position so as to bias said outer sleeve and inner member toward each other at a location which includes said groove in said inner member.

8. The heating chamber as defined in claim 7 wherein said means for conducting a pressurized fluid into contact with said rear surface includes secondary duct means communicating with said heating duct means so that a portion of the hot pressurized vapor supplied by said heating duct means is directed into contact with said rear surface.

9. The heating chamber as defined in claim 8 further comprising a first pair of sealing strips mounted on the exterior surface of said inner member, said first pair of sealing strips being disposed on respective opposite sides of said groove in said inner member and extending longitudinally along substantially the entire length thereof and so that said sealing strips are sealably disposed between the mating surfaces of said outer sleeve and inner member, and a second pair of sealing strips operatively associated with said rear surface, said second pair of sealing strips extending longitudinally along substantially the entire length of said rear surface and being laterally spaced apart a distance greater than that of said first pair of longitudinal sealing strips.

10. The heating chamber as defined in claim 9 further comprising a transverse sealing strip extending between said first pair of sealing strips adjacent each end thereof, and a second transverse sealing strip extending between said second pair of sealing strips adjacent each end thereof.

11. The heating chamber as defined in claim 8 wherein said rear surface of said inner member comprises that portion of the exterior surface thereof which is opposite said groove in said inner member.

12. The heating chamber as defined in claim 8 wherein said inner member includes an axially extending channel formed in the exterior surface thereof, and at least one insert positioned in said channel, with each insert including an outer surface facing said bore of said sleeve and having at least a portion of said groove formed therein, and with each insert further including an oppositely facing inner surface.

13. The heating chamber as defined in claim 12 wherein said rear surface of said inner member comprises said inner surface of each of said inserts.

14. The heating chamber as defined in claim 8 wherein said inner member includes an axially extending channel formed in the exterior surface thereof on the side opposite said groove in said inner member, said channel having a bottom wall and opposite side walls, and wherein said inner member further includes at least one insert positioned in said channel and having an outer surface facing said bore of said sleeve and an oppositely facing inner surface which overlies said bottom wall of said channel.

15. The heating chamber as defined in claim 14 wherein said rear surface of said inner member comprises said bottom wall of said channel and wherein said secondary duct means conducts said hot pressurized vapor into the area between said bottom wall of said channel and said inner surface of each of said inserts.

16. The heating chamber as defined in claim 8 wherein said heating duct means includes a passageway extending coaxially along said inner member, and at least one radial duct extending between said passageway and said groove in said inner member.

17. The heating chamber as defined in claim 16 further comprising condensate separation means operatively associated with said passageway for removing any condensate and gases which have a temperature below that of the hot vapor introduced by said heating duct means.

18. The heating chamber as defined in claim 8 wherein said groove formed in the inner surface of the bore of said outer sleeve comprises a slot extending through the wall of said outer sleeve along the entire axial length thereof, and so as to permit a yarn to be laterally inserted through said slot and into the groove of said inner member when said members are in said threading position.

19. A heating chamber for thermally processing an advancing yarn, and comprising a first elongate member having a generally flat front surface, and a groove formed in said flat surface and extending along the longitudinal length thereof, a second elongate member having a generally flat front surface, at least one of said first and second members including a rear surface which faces oppositely from the associated front surface of such member, means mounting said first and second members with said front surfaces thereof in an overlying relationship and for movement along a direction which is generally transverse to the direction of said groove, and between an operative position wherein said front surface of said second member overlies the groove in the front surface of said first member to define a relatively narrow yarn passage, and a threading position wherein said front surface of said first member is positioned relative to the front surface of said second member to define an enlarged opening to facilitate threading of a yarn, heating duct means for introducing a hot pressurized vapor into said yarn passage when said members are in the operative position, and biasing means for conducting a pressurized fluid into contact with said rear surface when said members are in the operative position so as to bias said front surfaces of said members toward each other.

20. The yarn heating chamber as defined in claim 19 wherein said biasing means includes secondary duct means communicating with said heating duct means for conducting a portion of said hot pressurized vapor into contact with said rear surface.

21. The yarn heating chamber as defined in claim 20 further comprising a rigid housing substantially enclosing said first and second members and for resisting a separating force exerted by said hot pressurized vapor in said groove.

22. The yarn heating chamber as defined in claim 21 wherein said heating duct means includes a passageway in said first member and extending in a direction parallel to said groove, and said secondary duct means extends between said passageway and said rear surface, and so that the hot pressurized vapor is conducted between said rear surface and said rigid housing.

23. A heating chamber for thermally processing an advancing yarn, and comprising a first elongate plate having a front surface defined by two parallel and laterally offset planes, and with a transverse shoulder formed between said planes and extending along the longitudinal length of said front surface, a second elongate plate having a front surface defined by two parallel and laterally offset planes, and with a transverse shoulder formed between said planes and extending along the longitudinal length of said front surface, and with said front surface of said second plate being substantially congruent with said front surface of said first plate, means mounting said first and second plates with said front surfaces thereof in an overlying relationship and for movement along a direction which is perpendicular to said shoulders, and between an operative position wherein said shoulders are closely spaced apart to define a yarn passage, and a threading position wherein said shoulders are widely spaced apart to facilitate yarn threading, at least one of said first and second plates including a rear surface which faces opposite from the associated front surface thereof, heating duct means for introducing a hot pressurized vapor into said yarn passage when said plates are in said operative position, and biasing means for conducting a pressurized fluid into contact with said rear surface when said plates are in said operative position and so as to bias said front surfaces toward each other.

24. A heating chamber as defined in claim 23 wherein said heating duct means includes a passageway in one of said plates and extending in a direction parallel to safd shoulders, and secondary duct means extending between said passageway and said yarn passage when said plates are in said operative position.

25. The heating chamber as defined in claim 24 wherein said means for conducting a pressurized fluid into contact with said rear surface includes further duct means communicating with said heating duct means for conducting a portion of said hot pressurized vapor into contact with said rear surface.

* * * * *